US005461990A

United States Patent [19]

Newman

[11] Patent Number: 5,461,990

[45] Date of Patent: Oct. 31, 1995

[54] MOUNTING AND LINKAGE SYSTEM FOR BURNERS IN A FURNACE

[75] Inventor: Lawrence F. Newman, Dumont, N.J.

[73] Assignee: Foster Wheeler Energy Corporation, Clinton, N.J.

[21] Appl. No.: 288,863

[22] Filed: Aug. 11, 1994

[51] Int. Cl.[6] ..... F23C 1/10

[52] U.S. Cl. ..... 110/261; 110/263; 122/449

[58] Field of Search ..... 110/261, 265, 110/297, 309, 313, 337, 263; 122/479.3, 449; 431/176

[56] References Cited

U.S. PATENT DOCUMENTS 2,363,875 11/1944 Kreisinger et al. ..... 110/263

2,575,885 11/1951 Mittendorf ..... 122/479.3

4,304,196 12/1981 Chadshay et al. ..... 110/261 X

*Primary Examiner*—Denise L. Gromada

*Assistant Examiner*—Susanne C. Tinker

*Attorney, Agent, or Firm*—Marvin A. Naigur

[57] ABSTRACT

A mounting and linkage system for mounting an air or air-fuel discharge device for pivotal and axial movement relative to a furnace in a manner so that the device is isolated from the walls of the furnace. The system includes a linkage apparatus extending between the furnace walls and connected to the device for pivoting same.

28 Claims, 3 Drawing Sheets

MOUNTING AND LINKAGE SYSTEM FOR BURNERS IN A FURNACE

FIELD OF THE INVENTION

This invention relates generally to a coal-fired furnace and, more particularly, to a furnace utilizing a plurality of burners disposed adjacent the corners thereof and directed to discharge pulverized coal in a direction towards the center of the furnace.

Many types, arrangements and locations of burners are utilized in coal-fired furnaces. For example, in some designs the burners are mounted relative to the furnace walls in a manner to discharge a mixture of coal and primary air in a direction perpendicular to the walls. Another technique known as tangential firing has evolved which involves the disposition of one or more burners in each of the corners of the furnace which fire generally towards the center of the furnace or generally tangentially with respect to an imaginary circle located in the center of the furnace. In these arrangements, a mixture of coal and air are usually discharged from the burners and secondary air is discharged from one or more air nozzles located adjacent the respective burners. These type of arrangements are quite popular since they achieve good mixing of the coal and the air, relative stable flame conditions and relative long residence time of the combustion gases in the furnace.

Tangentially fired furnaces provide additional advantages when the walls of the furnace include a plurality of water tubes for circulating water to heat the water to generate steam. Specifically, tangential firing permits the steam temperatures to be controlled over a fairly wide range by tilting the burners and air nozzles in a vertical direction to raise or lower the fireball in the center of the furnace which, in turn, decreases or increases the heat absorption by the furnace walls and the fluid circulating therethrough. Also, as the load, and therefore the furnace temperature, decrease, the burners can be tilted upwardly to raise the fireball in the furnace in order to maintain the furnace temperature high enough to keep the steam temperature up and thus achieve efficient low-load operation while maintaining overall cycle efficiency. In addition, the burners can also be tilted upwardly to compensate for changes in heat absorption within a furnace waterwall resulting from fuel variations.

In these type arrangements, the tilting of the burners and air nozzles is often achieved by linkage systems which are located in the windbox of the furnace and extend to an area behind the rear portions of the burners and the nozzles. However, the mounting and linkage systems are often elaborate and require several moving parts which tend to jam and break. Also, the mounting and linkage systems are often exposed to differential temperatures which cause corresponding relative differential expansion and contraction and potential damage.

SUMMARY OF THE INVENTION

It is therefore an object of the present invention to provide a linkage and mounting system for a tangentially fired burner and air nozzle which enables the burner and nozzle to tilt in a vertical direction.

It is a further object of the present invention to provide a mounting and linkage system of the above type which is simple in construction and easy to install.

It is still a further object of the present invention to provide a mounting and linkage system of the above type which is constructed and arranged in a manner to accommodate relative thermal differential expansion.

Towards the fulfillment of these and other objects, the mounting and linkage system of the present invention is adapted to support an air or air-fuel discharge device and includes a support shaft or shafts extending between two walls and adapted to pivotally mount the device in a manner so that the device is thermally isolated from the walls. A linkage assembly is connected to the device for pivoting same and also extends between the walls to isolate the linkage assembly from said walls.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
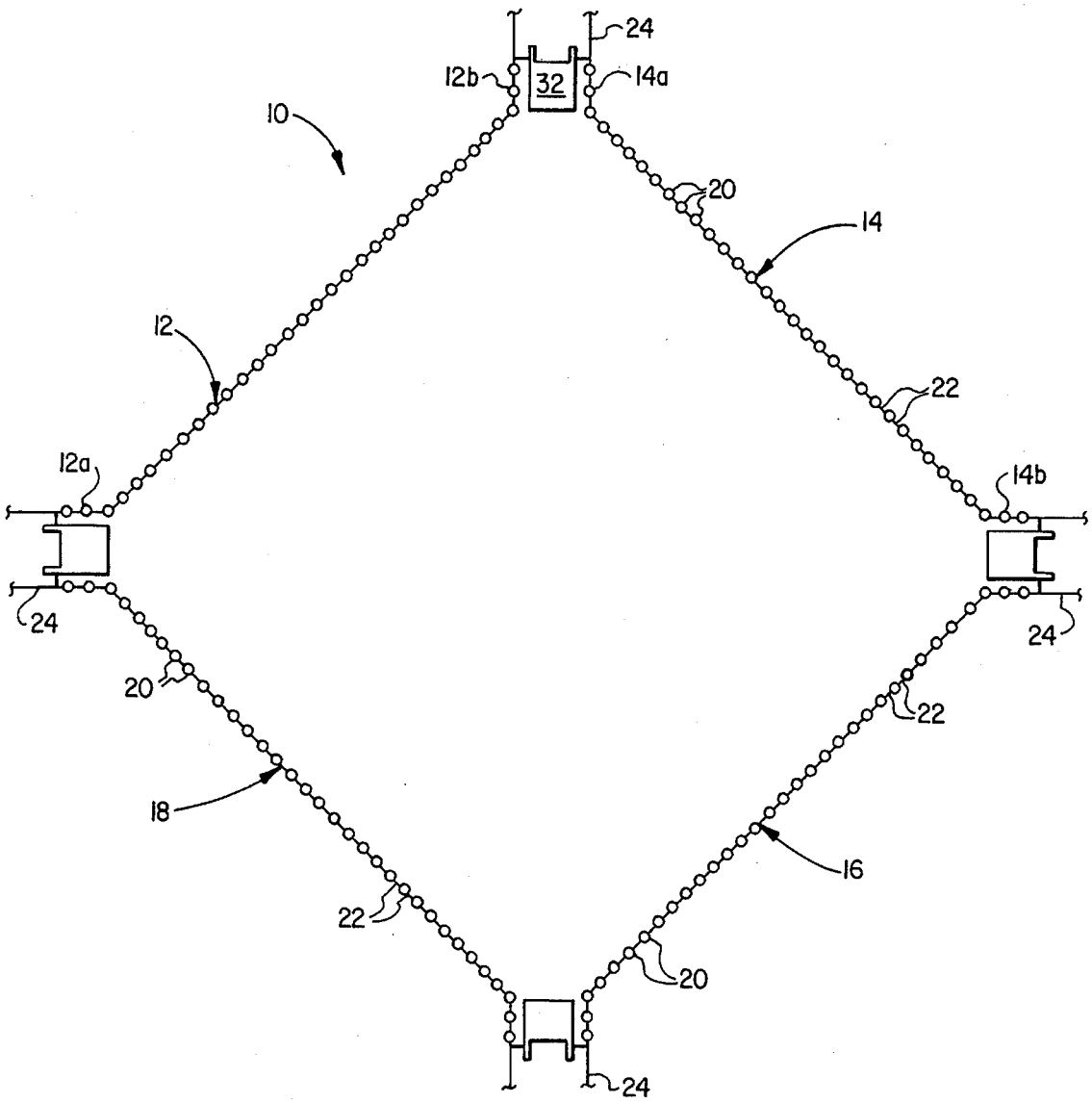
FIG. 1 is a top plan view of a furnace wall arrangement in a tangentially fired furnace in which the mounting and linkage system of the present invention is utilized.

Referring to FIG. 1 of the drawings, a tangentially fired furnace is shown in general by the reference numeral 10. The furnace 10 includes four vertical walls 12, 14, 16, and 18 each of which is formed by a plurality of spaced, parallel, vertically extending water tubes 20. A plurality of elongated fins 22 extend between adjacent tubes and are connected thereto in a conventional manner to render the walls gas-tight.

As shown with reference to the walls 12 and 14 for example, the respective end portions **12*a* and 12*b* of the wall 12 and the respective end portions 14*a* and 14*b* of the wall 14 are bent at an outwardly-extending angle which can vary depending on the particular design and which, for the purpose of example only, is forty-five degrees. Thus, the adjacent wall portions 12*b* and 14*a* of the walls 12 and 14, respectively, extend in a spaced, parallel relation and are connected, in a manner to be described, to the corresponding walls of a windbox 24. The walls 16 and 18 are configured in the same manner and a windbox 24 is located in each corner of the furnace 10**.

Figure 2:
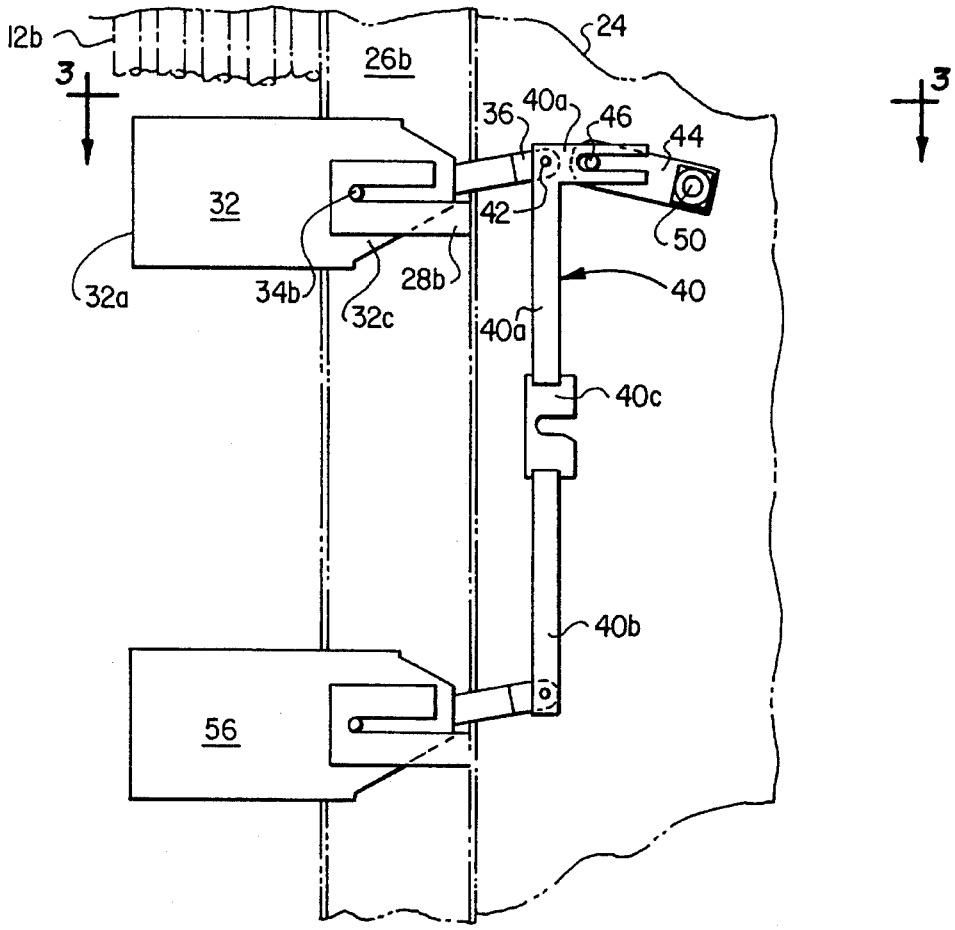
FIG. 2 is an enlarged view of a corner of the furnace of FIG. 1, depicting two air discharge devices along With the mounting and linkage system of the present invention.
Figure 3:
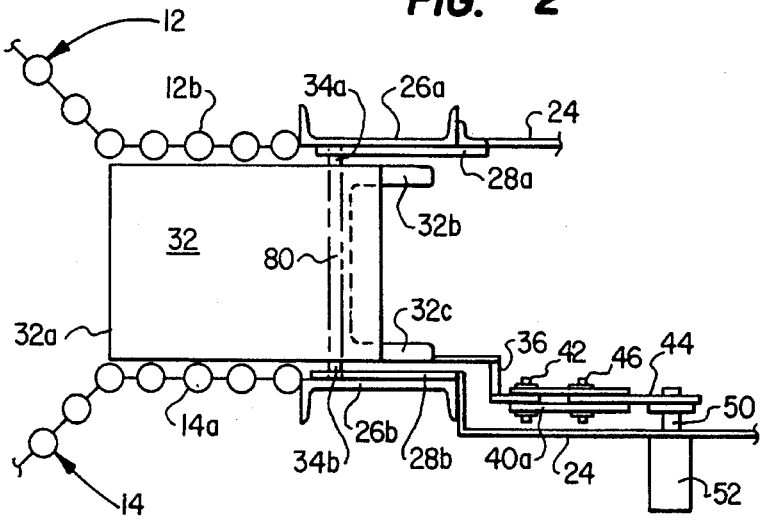
FIG. 3 is a cross-sectional view taken along the line 3—3 of FIG. 2.

Referring to FIGS. 2 and 3, a pair of vertically-extending spaced, opposed channel members **26*a* and 26*b* are respectively mounted adjacent the bent wall portions 12*a* and 14*a* and extend between the latter portions and the corresponding walls of the windbox 24. It is noted that the channel members 26*a* and 26*b* are not shown in FIG. 1 and the number of tubes shown comprising the bent wall portions 12*b* and 14*a* are less than that shown in FIG. 2** due to limitations of scale.

A pair of U-shaped mounting plates 28*a* and 28*b* are secured to the channel members 26*a* and 26*b*, respectively, in any known manner and each define an elongated slot as shown in connection with the plate 28*a* in FIG. 1. A pair of mounting pins, or rods, 34*a* and 34*b* extend from the plates 28*a* and 28*b*, respectively, and are integral with a pair of keys (not shown) that are supported in the slots. An air discharge device 32 is mounted between the wall portions 12*b* and 14*a* and the channel members 26*a* and 26*b*. The discharge device 32 is in the form of a hollow casing having a pair of openings respectively formed through its sidewalls which receive the mounting pins 34*a* and 34*b*, respectively, to mount the device 32 for pivotal and axial movement relative to the channel members 26*a* and 26*b*. Although not clear from the drawings, it is understood that a discharge opening is formed in a discharge end 32*a* of the device 32 which end can be tilted upwardly and downwardly relative to the furnace walls as will be described.

A pair of lobes 32*b* and 32*c* (FIG. 3) are formed at the end of the discharge device 32 opposite the discharge end 32*a*, and the lobe 32*c* is connected, by a stepped link 36, to an L-shaped connecting arm 40. As shown in FIG. 2, the arm 40 has an L-shaped upper portion 40*a*, a straight, lower portion 40*b*, and a slotted center portion 40*c*. The upper arm portion 40*a* and the lower arm portion 40*b* are bifurcated, i.e., they are formed by two parallel, slightly spaced arms, as shown in connection with the upper arm portion 40*a* in FIG. 3. One leg of the link 36 extends within the upper, bifurcated arm portion 40*a*, and a pin 42 extends through corresponding openings formed in the latter leg of the link 36 and the arm portion 40*a* to pivotally mount the link 36 relative to the arm 40.

In a similar manner, one end of another link 44 also extends within the bifurcated arm portion 40*a*, respectively, and a pin 46 extends through an opening provided in one end portion of the link 44 and through an axial slot (FIG. 2) provided in the corresponding end of the arm portion 40*a*. Thus the latter end portion of the link 44 can slide and rotate relative to the arm portion 40*a* for reasons to be described.

One end of a drive shaft 50 is secured within an opening formed in the other end of the link 44 and the other end of the shaft is connected to a drive mechanism 52 mounted on a wall of the windbox 24. The drive mechanism 52 operates in a conventional manner to apply a torque to drive the shaft 50 in both a clockwise and counter-clockwise direction. Since the drive mechanism is conventional, it will not be described in any further detail.

An additional air discharge device 56, which is similar to the device 32, extends below the device 32 and is connected to the other ends of the lower arm portion 40*b*. Since this connection is made by a linkage system which is identical to the above-described linkage system, it will not be described in detail.

Although not shown in FIG. 2 for the convenience of presentation, an air-fuel burner is also mounted between the wall portions 12*b* and 14*a* and the channel members 26*a* and 26*b* and is vertically spaced from, and extends between, the air discharge devices 32 and 56. The air-fuel burner is shown in general by the reference numerical 60 in FIGS. 4 and 5 and includes a pivotal or rotatable discharge head portion 62 mounted over, and pivotal with respect to, a fixed body portion 64 about a horizontal axis A, in a conventional manner. The discharge end of the head portion 62 extends flush with the discharge ends of the air discharge devices 32 and 56, respectively, and the other end portion of the head portion 62 is enlarged and extends over a correspondingly shaped end portion of the fixed body portion 64. The other end of the body portion 64 is connected an outer barrel 65 for supplying a mixture of air and crushed coal to the burner 60 as fully disclosed in applicant's co-pending application (attorney's docket No. 10283.377) filed concurrently herewith and also assigned to the assignee of the present invention, with the disclosure of the latter application being incorporated by reference.

Figure 4:
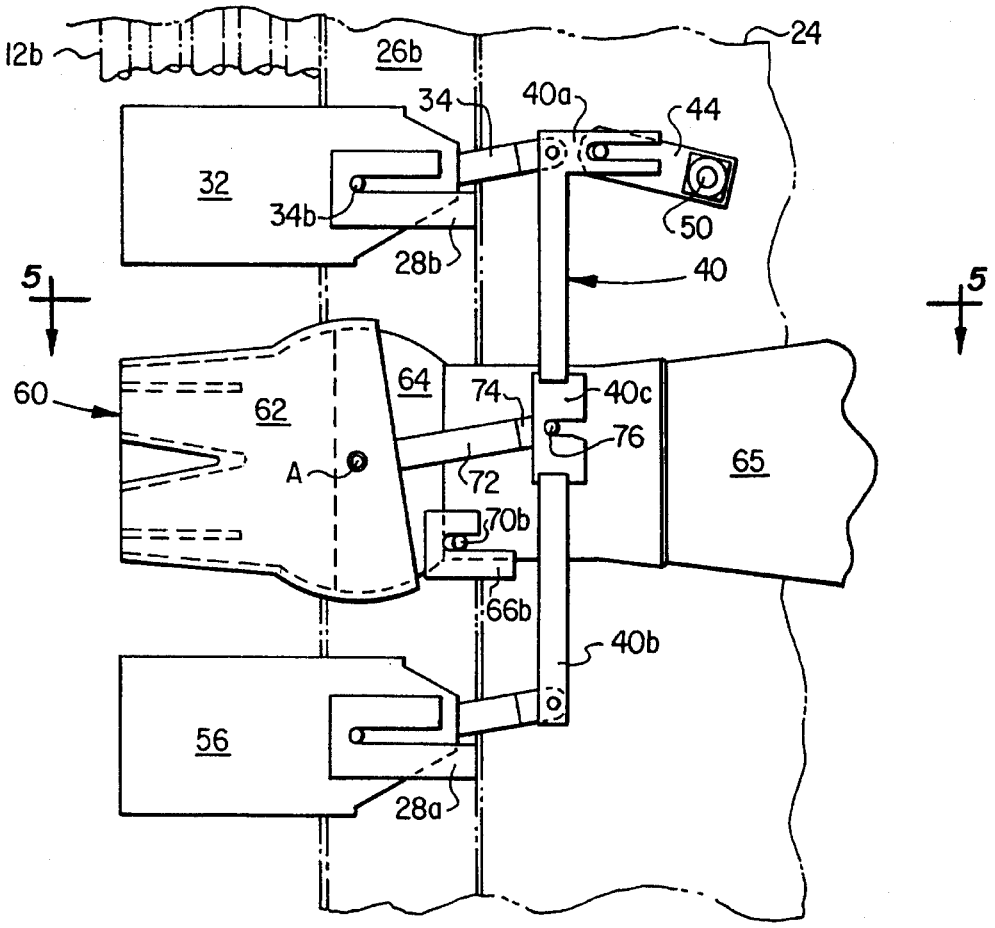
FIG. 4 is a view similar to FIG. 2, but including an air-fuel discharge device.
Figure 5:
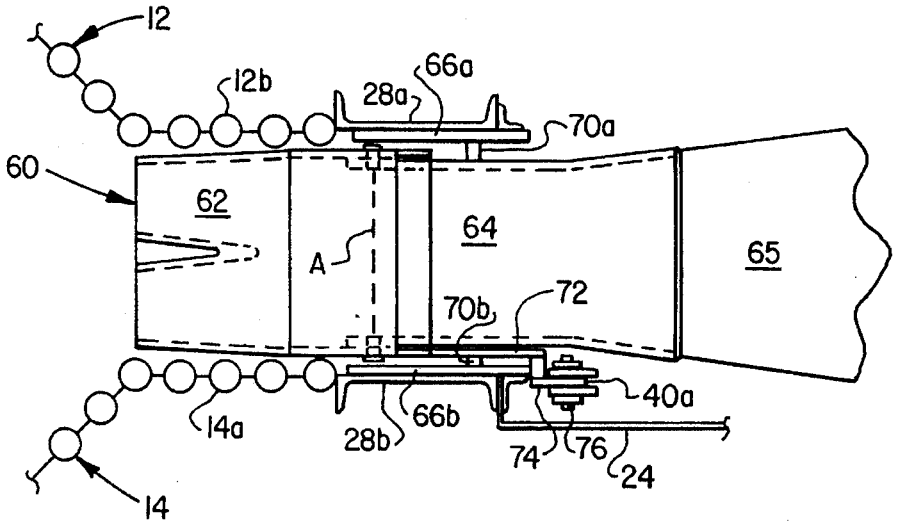
FIG. 5 is a cross-sectional view taken along the line 5—5 of FIG. 4.

A pair of U-shaped plates 66*a* and 66*b* (FIG. 5) are mounted to the channel members 26*a* and 26*b*, respectively, and each define a horizontal slot as shown in connection with the plate 66*b* in FIG. 4. Two support pins 70*a* and 70*b* (FIG. 5) extend outwardly from the respective opposite walls of the body portion 64 and into the slots of the plates 66*a* and 66*b*, respectively. Since the other end portion of the barrel 65 is secured to the windbox 24 in a manner not shown in the drawings, the body portion 64 is not pivotally mounted in the manner described in connection with the air discharge devices 32 and 56, but is movable axially relative to the channel members 26*a* and 26*b* in a manner to be described.

A link 72 extends from the rear end of the discharge head portion 62 and is connected to an L-shaped link 74. As shown in FIG. 4, the center arm portion 40*c* is enlarged and defines a slot which receives a horizontal pin 76 extending from the distal end of the latter leg of the link 74. Thus, the link 74, and therefore the link 72, are pivotally mounted relative to the arm 40.

In operation, rotation of the drive shaft 50 and the corresponding vertical movement of the arms 38 and 40 in the manner described above also causes a corresponding pivotal, or tilting, movement of the air discharge devices 32 and 56 relative to the channel members 26*a* and 26*b* and a similar movement of the discharge head portion 62 relative to the body portion 64 of the burner 60 about the axis A. It is noted that during this reciprocal up and down movement of the arm 40 in response to rotation of the shaft 50 in a clockwise and counterclockwise direction, respectively, the effective horizontal dimensions of the links 34 and 44 change as their angular position vanes, which changes are accommodated by the lost motion connection established by the slots formed in the arm portion 40*a*.

As a result of the foregoing, the air discharge devices 32 and 56, the burner 60 and their associated linkages are not rigidly connected to the channel members 26*a* and 26*b* or to the walls 12*b* and 14*a*. Therefore, any differential thermal expansion between the devices 32 and 56 and the burner 60 relative to walls 12*b* and 14*a* and/or the channel members 26*a* and 26*b* will be accommodated without causing any damage. Also,the slots in the center am portions 40*a* and 40*c*, as well as the slots in the plates 66*a* and 66*b* allow the burner 60 to "grow" or expand into the furnace 10 since the pins 70*a*, 70*b* and 76, respectively, can slide in these slots during this movement. Also, the slot in the center arm portion 40*c* allows the burner 60 to be removed and installed without disassembling its associated linkage mechanism. Further, the system of the present invention is simple in construction and enables the air discharge devices and the burner to be mounted quickly and easily.

It is understood that several variations may be made in the foregoing without departing from the scope of the invention. For example, the pins 34*a* and 34*b* shown in FIG. 2 can be replaced by a single pin 80 which extends between the plates 28*a* and 28*b* and through appropriate openings in the casing of the air discharge device 32. The ends of the pin 80 would extend into the slots in the plates 28*a* and 28*b* to pivotally mount the device 32 in the manner described above. Also, although the present invention has been described in connection with a tangentially fired furnace, it is understood that it is also applicable to other type furnaces.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. An assembly for mounting a discharge device relative to a windbox in connection with a furnace, the windbox having two spaced walls that define a space communicating with the interior of the furnace, said assembly comprising a pair of support pins extending outwardly through said walls and extending in corresponding openings in said device for mounting said device for pivotal and axial movement in said space, drive means for generating a torque, and linkage means connecting said drive means to said device for pivoting said device.

2. The assembly of claim 1 wherein said linkage means comprises at a first link member connected to said device, a second link member connected to said drive means and adapted for angular rotation relative to said first link member in response to said drive means generating said torque, and means for establishing connection between said link members for pivoting said device and accommodating said angular rotation.

3. The assembly of claim 2 wherein there is an additional device for discharging air or a mixture of air and fuel into said furnace, said additional device being located in a vertically spaced relation to said first-mentioned device, and further comprising support means for mounting said additional device for pivotal and axial movement relative to the walls of said furnace, and means connecting said additional device to said means for establishing said lost motion connection for pivoting said additional device in response to said drive means generating said torque.

4. The assembly of claim 1 wherein said support means comprises a pin mounted to said device with its respective end portions projecting outwardly from said device, and a pair of plates mounted to said walls and respectively defining a pair of slots for receiving said end portions.

5. The assembly of claim 1 wherein said axial movement is caused by differential thermal expansion and contraction of said device relative to said walls.

6. The assembly of claim 1 wherein said linkage means converts said torque to linear movement for pivoting said device.

7. The assembly of claim 1 wherein said device is located in a corner of said furnace and said walls extend from said comer in a spaced parallel relation.

8. The assembly of claim 1 wherein said discharge device discharges fuel, or a mixture of fuel and air, into said interior of said furnace and wherein said pivotal movement of said device changes the direction of said discharge.

9. Apparatus for discharging air or a mixture of air and fuel into a furnace, said apparatus comprising a discharge device for discharging fuel, or a mixture of fuel and air, into the interior of said furnace, said discharge device comprising a first member, means for mounting said first member relative to at least one wall of said furnace to permit relative movement between said first member and said wall, a second member extending over, and pivotally mounted relative to, said first member; drive means for generating a torque, and linkage means connecting said drive means to said second member for pivoting said second member relative to said first member to vary the direction of said discharge, said linkage means comprising means for permitting axial movement of said second member relative to said linkage means due to differential thermal expansion or contraction of said second member and said wall.

10. The apparatus of claim 9 wherein said linkage means comprises at a first link member connected to said second member, a second link member connected to said drive means and adapted for angular rotation relative to said first link member in response to said drive means generating said torque, and means for connecting said link members for pivoting said second member and accommodating said angular rotation.

11. The apparatus of claim 10 wherein there is an additional device for discharging air or a mixture of air and fuel into said furnace, said additional device being located in a vertically spaced relation to said first-mentioned device, and further comprising support means for mounting said additional device for movement relative to the walls of said furnace, and means connecting said additional device to said connecting means for pivoting said additional device in response to said drive means generating said torque.

12. The apparatus of claim 9 wherein said linkage means converts said torque to linear movement for pivoting said second member.

13. The apparatus of claim 9 wherein said linkage means comprises a first link connected to said second member, a second link connected to said drive means and adapted for angular rotation in response to said drive means generating said torque, and means for establishing a lost motion connection between said link members for pivoting said second member and accommodating said angular rotation.

14. The apparatus of claim 9 wherein said device extends between said two of said furnace walls in a spaced relation thereto.

15. The apparatus of claim 9 wherein said linkage means converts said torque to linear movement for pivoting said second member.

16. The apparatus of claim 9 wherein said device is located in a comer of said furnace and said walls extend from said comer in a spaced parallel relation.

17. The apparatus of claim 9 wherein said mounting means comprises two plates respectively mounted to said walls, with each plate defining a slot, and a pair of support pins extending outwardly from said first member and respectively into said slots.

18. Apparatus for discharging air or a mixture of air and fuel into a furnace having four walls defining at least one comer, said apparatus comprising two wall portions extending from said comer in a spaced relation to define a space communicating with the interior of said furnace, a discharge device extending in said space for discharging fuel, or a mixture of fuel and air, into the interior of said furnace, said discharge device comprising a first member, a pair of support pins extending outwardly from said first member, and a second member extending over, and pivotally mounted relative to, said first member; two plates respectively mounted to said wall portions with each plate defining a slot for respectively receiving said pins for mounting said first member relative to said wall portions while permitting relative movement between said first member and said wall portions; drive means for generating a torque; and linkage means connecting said drive means to said second member for pivoting said second member relative to said first member to vary the direction of said discharge, said linkage means comprising means for permitting axial movement of said second member relative to said linkage means.

19. The apparatus of claim 18 wherein said linkage means comprises a first link member connected to said device, a second link member connected to said drive means and adapted for angular rotation relative to said first link member in response to said drive means generating said torque, and means for connecting said link members for pivoting said device and accommodating said angular rotation.

20. The apparatus of claim 19 wherein there is an additional device for discharging air or a mixture of air and fuel into said furnace, said additional device being located in a vertically spaced relation to said first-mentioned device, and further comprising support means for mounting said additional device for movement relative to the walls of said furnace, and means connecting said additional device to said connecting means for pivoting said additional device in response to said drive means generating said torque.

21. The apparatus of claim 18 wherein said wall portions are formed, at least in part, by extensions of the furnace walls.

22. The apparatus of claim 21 further comprising a windbox, said wall portions being formed, at least in part by two walls of said windbox.

23. The apparatus of claim 18 wherein said axial movement is caused by differential thermal expansion and contraction of said device relative to said walls.

24. The apparatus of claim 18 wherein said linkage means converts said torque to linear movement for pivoting said second member.

25. The apparatus of claim 18 wherein said slots permit axial movement of said first member relative to said wall portions.

26. The apparatus of claim 18 wherein said latter axial movement is caused by differential thermal expansion or contraction of said device relative to said wall.

27. The apparatus of claim 18 wherein said linkage means comprises a first link connected to said second member, a second link connected to said drive means and adapted for angular rotation in response to said drive means generating said torque, and means for connecting said link members for pivoting said second member and accommodating said angular rotation.

28. The apparatus of claim 9 wherein said mounting means permits axial movement of said first member relative to said wall.

* * * * *

UNITED STATES PATENT AND TRADEMARK OFFICE

CERTIFICATE OF CORRECTION

PATENT NO. : 5,461,990

DATED : October 31, 1995

INVENTOR(S) : Lawrence F. Newman

It is certified that error appears in the above-indentified patent and that said Letters Patent is hereby corrected as shown below:

Col. 3, line 60, "numerical" should be --numeral--.

Col. 4, line 41, "vanes" should be --varies--.

Col. 5, line 37, claim 3, "lost motion" should be deleted.

Col. 6, line 31, claim 14, "lost motion" should be deleted.

Col. 6, line 41, "comer" should be --corner--.

Col. 6, line 41, "comer" should be --corner--.

Col. 6, line 50, "comer" should be --corner--.

Signed and Sealed this

Sixteenth Day of April, 1996

Bruce Lehman

*Attest:*

BRUCE LEHMAN

*Attesting Officer*

*Commissioner of Patents and Trademarks*